United States Patent [19]

Wiseblood

[11] 4,084,915

[45] Apr. 18, 1978

[54] METHOD FOR RECONDITIONING AND RESURFACING PAVEMENT

[76] Inventor: Nathan Wiseblood, 2000 Presidential Way, West Palm Beach, Fla. 33401

[21] Appl. No.: 729,027

[22] Filed: Oct. 4, 1976

[51] Int. Cl.[2] ..... E01C 7/06

[52] U.S. Cl. ..... 404/77; 404/19

[58] Field of Search ..... 404/77, 72, 90, 95, 404/91, 92, 75, 19, 20, 21

[56] References Cited

U.S. PATENT DOCUMENTS

| | | | |
|---|---|---|---|
| 1,195,273 | 8/1916 | Scheerer | 404/20 |
| 1,370,815 | 3/1921 | Henderson | 404/77 |
| 1,689,123 | 10/1928 | Finley | 404/75 |
| 2,053,709 | 9/1936 | Flynn | 404/75 |
| 2,229,872 | 1/1941 | Pullar | 404/75 X |
| 2,254,463 | 9/1941 | Wells | 404/95 |
| 2,925,831 | 2/1960 | Welty | 404/20 X |
| 3,361,042 | 1/1968 | Cutler | 404/77 |
| 3,417,677 | 12/1968 | Moser et al. | 404/77 |
| 3,807,886 | 4/1974 | Cutler | 404/77 |
| 3,970,404 | 7/1976 | Benedetti | 404/77 |

*Primary Examiner*—Nile C. Byers

*Attorney, Agent, or Firm*—Schiller & Pandiscio

[57] ABSTRACT

This invention provides a new and low-cost method for reconditioning existing bituminous concrete pavement and simultaneously resurfacing it with a non-skid, light-reflecting material.

9 Claims, 1 Drawing Figure

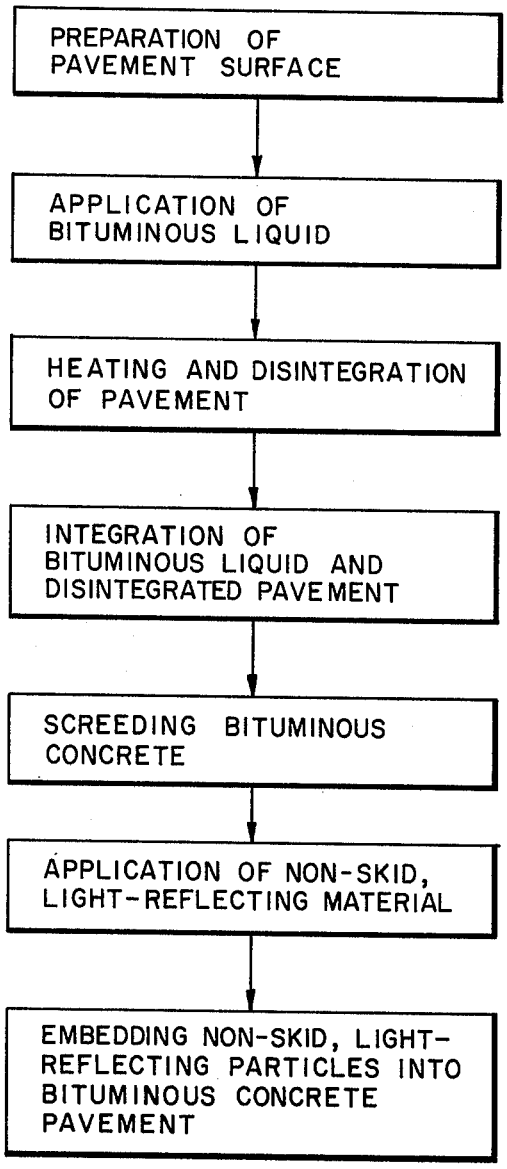
PREPARATION OF PAVEMENT SURFACE
APPLICATION OF BITUMINOUS LIQUID
HEATING AND DISINTEGRATION OF PAVEMENT
INTEGRATION OF BITUMINOUS LIQUID AND DISINTEGRATED PAVEMENT
SCREEDING BITUMINOUS CONCRETE
APPLICATION OF NON-SKID, LIGHT-REFLECTING MATERIAL
EMBEDDING NON-SKID, LIGHT-REFLECTING PARTICLES INTO BITUMINOUS CONCRETE PAVEMENT

METHOD FOR RECONDITIONING AND RESURFACING PAVEMENT

BACKGROUND OF THE INVENTION

A. Field of the Invention

This invention relates to bituminous concrete surfaces in general and in particular to a new method for reconditioning existing bituminous concrete pavement and simultaneously resurfacing it with a non-skid, light-reflecting material.

B. Description of the Prior Art

It is a well-known fact that asphalt and tar generally tend to lose their shiny black surfaces and turn a dull grey color in time. This is due to the oxidation and weathering of the bituminous concrete, a natural process which robs the bituminous cement of its residual oils. Loss of these oils gradually causes the pavement to turn hard and brittle, and soon leads to the appearance of cracks and the eventual disintegration of the bituminous surface.

Since this development in the pavement is undesirable, various repair techniques have been employed by the construction industry to counteract the pavement deterioration. The standard one consists of the following five-step procedure:

(1) cleaning the top surface of the pavement to remove all foreign matter;

(2) filling all cracks with crack-filler cements;

(3) raising all utility terminals and curbing to the height of the new resurfacing grades;

(4) placing a tack coat of hot or cold bituminous liquid on the old pavement; and (5) swelling and resurfacing the old pavement with a new layer or layers of bituminous concrete.

While this conventional repair technique is effective, there are a number of problems associated with it. First, this procedure is quite expensive in terms of manpower and materials. Second, since these repairs require a good deal of time to accomplish and since the pavement must be closed to traffic during the period of repair, this procedure often means extensive traffic detours and user inconvenience. Third, because these repairs must take place every five to ten years in a typical environment and even more often in an inclement one, layer after layer of bituminous concrete is deposited on the roadbed with time, with the newer surfaces being laid down on top of the older ones. This means that each time a new layer of bituminous concrete is added, all existing utility terminals and curbing must be raised to the height of the new surface. Furthermore, the level of the pavement eventually rises so high as to surpass the level of the surrounding terrain. When this occurs, all the bituminous surfacing must be torn out down to the level of the roadbed and the construction of the surfacing must be begun again. As might be expected, tearing out the accumulated layers of bituminous concrete is an expansive and time-consuming process.

OBJECTS OF THE PRESENT INVENTION

Subsequently, one of the objects of the present invention is to provide a method for reconditioning bituminous concrete pavement which restores the bituminous concrete to substantially its original condition while solving the aforementioned problems.

Another object is to provide a method for embedding a non-skid, light-reflecting material in the upper surface of a bituminous concrete pavement during the reconditioning process.

Another object is to provide a method for returning an aged bituminous pavement to its previous flexibility, resiliency and resistance to impact by simply reworking the upper oxidized and weathered surface of the pavement.

Another object is to provide a method for reconditioning and resurfacing an existing pavement in such a manner that utility terminals and curbing do not require alteration.

Another object is to provide a method for reconditioning and resurfacing an existing pavement which will be allow the pavement surface to be opened to traffic within a few hours' time so as to minimize traffic disruption and user inconvenience.

Another object is to provide a method for reconditioning and resurfacing bituminous concrete pavements which costs less than existing techniques.

Another object is to provide a method for reconditioning and resurfacing bituminous concrete pavement which makes use of low-cost waste or reclaimed oils, and waste sludges.

Another object is to provide a method for reconditioning and resurfacing bituminous concrete surfaces which utilizes a vitreous, pozzolanic mineral aggregate, produced as a residue in the high temperature burning of household waste and garbage, to form a non-skid, light-reflecting pavement surface.

Another object is to provide a method for reconditioning and resurfacing bituminous concrete surfaces which allows for the elimination of some or all of the painted road safety lines by making use of non-skid, light-reflecting aggregates of different colors to designate traffic lanes.

Still other objects, the nature and many of the advantages of this invention will become readily obvious in the course of the following detailed description, which is to be considered together with the accompanying diagram.

BRIEF DESCRIPTION OF THE INVENTION

The present invention involves a new method for reconditioning existing bituminous concrete pavement and also a new method for resurfacing pavement with a non-skid, light-reflecting material. Basically, the present invention consists of the following steps:

(1) cleaning the surface of the old pavement, if necessary;

(2) applying a bituminous liquid onto the surface of the existing pavement;

(3) heating and disintegrating the upper portion of the old bituminous concrete surface to a predetermined depth;

(4) integrating the bituminous liquid into the distintegrated bituminous concrete surface;

(5) screeding the mixture to restore the smooth original road grade;

(6) treating the concrete, if necessary, with more bituminous liquid;

(7) application of a non-skid, light-refecting aggregate material of selected particle size onto the bituminous concrete surface; and (8) embedding the non-skid, light-reflecting material into the bituminous concrete so as to form a smooth surface.

These steps are explained in greater detail hereinafter.

DETAILED DESCRIPTION OF THE SPECIFIC FEATURES OF THE PRESENT INVENTION

In the usual case, the first step for this new procedure for reconditioning and resurfacing worn bituminous concrete pavement consists of cleaning the surface of the old pavement to remove all large particles of foreign matter lying on the pavement, such as heavy dirt, bottles, rocks, cans, leaves, etc., so that the surface of the pavement will be well exposed. Various techniques for accomplishing this are well known to persons skilled in the art and equipment for doing so is readily available, e.g., sweeping the pavement with conventional street sweepers.

Once the surface of the pavement has been cleared of all debris, it is ready to be treated with a bituminous liquid. Treatment consists of applying between about 0.10 and about 0.60 (and preferably about 0.40) gallons of the liquid upon each square yard of the upper surface of the worn pavement. Application is preferably made by means of a sprayer, though a roller, brush or other suitable means may also be used. The bituminous liquid is composed of a complex mixture of hydrogen, carbon and oxygen conforming to specifications defined by the American Association of State Highway Officials (AASHO). The bituminous liquid may comprise a combination of mineral oils and asphalt emulsions at a temperature of between about 50° F. and about 150° F, a combination of mineral oils and cut-back ashphalts at a temperature of between about 100° F and about 200° F, or a similar composition at a suitable temperature. Preferably, though not necessarily, the bituminous liquid will utilize waste sludges and low-cost waste or reclaimed oils derived from petroleum products. These oils and sludges are very compatible with bituminous concretes and help to enhance their cementitious nature as well as increasing their plasticity, flexibility and ductility by becoming a component of the bituminous cements themselves. Furthermore, by making use of these petroleum oils and waste sludges in this manner, not only is a cheap source of bitumin tapped but also previous problems associated with the disposal of waste oil and sludges are solved, since the bituminous cement will not leach out of the pavement back into domestic water supplies as the waste and oil sludges tended to do under previous disposal techniques.

Once the bituminous liquid has been applied, the next step consists of heating and disintegrating the upper portion of the old bituminous concrete surface to a predetermined depth. This involves heating the surface of the pavement to a temperature of between about 180° F and about 250° F, preferably though not necessarily with infra-red heaters, and then breaking up the surface of the pavement to a depth of at least about 0.5 inches and preferably between about 0.75 to about 2.5 inches by mechanical choppers or cutters. Disintegrating the pavement to a depth greater than about 2.5 inches may be done but is not peferred.

Next the bituminous liquid is integrated into the disintegrated bituminous concrete. This is partially accomplished during the disintegrating step and is now completed by means of conventional mechanical mixer elements, e.g., such as a Culter Helio Planer.

The fifth step consists of passing one or more screeds over the disintegrated bituminous cement to restore the smooth, original grade of the pavement. This step also further integrates the bituminous liquid into the disintegrated concrete.

At this point the surface of the pavement is checked for bituminous liquid content. If more is needed, a new layer of bituminous liquid (preferably hot) may be applied.

Then, while the rich upper mixture of bituminous concrete and bituminous liquid is still hot enough to be soft and pliable, a non-skid, light-reflecting aggregrate material is laid down on the pavement. Preferably, though not necessarily, this material is a hard, vitreous pozzolanic mineral aggregate produced as a part of the residue in the pyrolysis, i.e., burning at temperatures of about 2000° F and higher, of household waste and garbage. This mineral aggregate which is separated from the residue by conventional techniques, comprises a colored, vitreous light-reflecting substance and a pozzolanic substance. The aggregate is approximately, by weight, 35 to 55% vitreous material and 45 to 65% pozzolanic material. Typically the vitreous material is composed by weight of about 25–30% inorganic siliceous material, about 2–5% alumina, about 1% soda, and about 60–70% melted glass. Typically the pozzolanic substance is formed, by weight, of about 2–8% fly ash, about 2–8% alumina, about 85–90% non-glassy siliceous material. The exact composition of the vitreous material and the pozzolanic substance and the color of the aggregates will vary somewhat due to the imprecise nature of the composition of household wastes and garbage. Usually the aggregates are multicolored. The aggregate from this high temperature burning is usually in large pieces which may then be crushed into smaller particles of irregular shape and thus serve to impart a light-reflecting, high-traction characteristic to the road pavement. Approximately 15 to 40 pounds of this aggregate are spread on each square yard of pavement surface, with each aggregate particles preferably being about $\frac{1}{2} \times \frac{1}{2} \times \frac{1}{2}$ inch in size or smaller and a volume of about 0.12 cubic inches.

The final step is to embed this non-skid, light-reflecting material into the soft bituminous concrete so as to form a relatively smooth finished surface. This is done by running large rollers over the surface of the pavement so as to force the non-skid reflecting particles into the pavement itself, thereby fixing the particles in place on the top of the road.

When this is completed, the road must be left unused for approximately $\frac{1}{4}$ to 2 hours so as to allow the bituminous concrete to harden sufficiently to be usable.

An example is hereinafter provided to more fully describe the preferred mode of practicing the present invention.

EXAMPLE

When implementing the present invention, a section of existing bituminous concrete pavement is first chosen for reconditioning and resurfacing. An appropriate pavement might be approximately seven years old and characterized by a dull grey appearance and the presence of small cracks in its upper surface. Then an inspection is made of the pavement. If a significant amount of foreign debris, such as heavy dirt, bottles, rocks, leaves, etc., is found on the pavement, a standard street sweeper is employed to clear off the debris and thus expose the upper surface of the road.

Once the road surface is well-exposed, it is treated with bituminous liquid. Treatment consists of spraying about 0.4 gallons of the liquid upon each square yard of the upper surface of the worn pavement. The bituminous liquid is composed of approximately 50% waste sludge and reclaimed petroleum oils and 50% asphalt emulsions. The bituminous liquid is applied at an approximate temperature of 100° F.

Once the bituminous liquid has been applied to the surface of the pavement, an infra-red heater unit is passed over that surface, heating the bituminous concrete to a temperature of approximately 225° F, whereby the upper surface of the pavement is softened. Then mechanical choppers are used to break up the softened pavement down to a depth of approximately 1 inch.

Next power-operated mechanical mixers are employed to mix and fully integrate the disintegrated bituminous concrete with the bituminous liquid. Once this is done a screed is passed over the concrete to level the surface of the roadway.

At this point an inspection is made of the bituminous concrete to determine if sufficient bituminous liquid has been added to the concrete to substantially restore it to its original condition of flexibility and softness. If not, a new layer of the liquid is added, preferably hot.

Then, while the bituminous concrete is still hot and pliable, a non-skid, light-reflecting mineral aggregate is laid down on top of the concrete. This aggregate is a vitreous pozzolanic material produced as a residue in the high temperature (2000° F) burning of household wastes and garbage. This mineral residue comprises (1) a multi-colored, vitreous, light-reflecting substance, formed primarily of inorganic siliceous material (about 26 wt.%) combined with alumina (about 3 wt.%) soda (about 1 wt.%), melted glass (about 65 wt.%) and miscellaneous other inorganic materials (about 5 wt.%); and (2) a pozzolanic substance formed of fly ash (about 5 wt.%), alumina (about 3 wt.%), non-glassy siliceous material (about 87 wt.%) and miscellaneous other inorganic materials (about 5 wt.%). The aggregate is approximately 45% vitreous material by weight and 55% pozzolanic material by weight and is in the form of irregular shapes having a maximum size of about ⅝ inch and a volume of about 0.12 cubic inches in size. The aggregate is spread evenly over the pavement with about 30 pounds of the aggregate being applied to each square yard of pavement surface.

To embed this non-skid, light-reflecting material into the soft bituminous concrete, a heavy roller is driven over the pavement. This forces the non-skid, light-reflecting particles into the pavement itself, thereby fixing the particles in place on the top of the road.

This completes the reconditioning and resurfacing procedure. Now the road must be left unused for approximately ¼ to 2 hours to allow the bituminous concrete time to harden, whereupon it may be opened to traffic.

ADVANTAGES OF THE PRESENT INVENTION

There are numerous advantages to using this reconditioning and resurfacing process. First, the bituminous concrete pavement is reconditioned in less time and less cost than required with other methods. Second, this is accomplished without altering the height of the pavement surface, which means that all utility terminals and curbing can remain untouched and do not have to be raised with the road surface. Third, the pavement may be used just minutes after the work is completed, minimizing disruption to traffic. Fourth, a special non-skid, light-reflecting material may be applied to the pavement surface during the reconditioning and resurfacing process. This increases traction on the pavement, reflects heat and cold to lengthen tire and pavement life and reflects light for improved visibility. Furthermore, by utilizing vitreous, non-skid materials of different colors, it is possible to provide distinct demarcations of different areas of the pavement, so that painted road safety lines can be partially or completely eliminated. For example, high speed exit lanes on limited access highways may be treated with reflecting aggregates as herein described so as to facilitate early identification of such lanes by motorists. And fifth, additional savings can be realized when waste materials such as oil sludges and household garbage are used for construction materials.

MODIFICATIONS OF THE PRESENT INVENTION

Finally, it should be noted that the preferred embodiment described herein is intended solely for the sake of example and clarity and is to be in no way construed as limiting the scope of the present invention, since various alterations may be carried out on the preferred embodiment without departing from the essential features of the present invention.

Thus, for example, one might completely integrate the bituminous liquid with the heated bituminous concrete at the same time as the concrete is disintegrated. In this way steps (3) and (4) would be consolidated into one. Similarly, retreating the disintegrated bituminous concrete with more bituminous liquid may be done before screeding or not at all. The heating of the bituminous concrete pavement also may take place before the bituminous liquid is laid down, to be followed by disintegration of the concrete pavement after the liquid is applied.

These and other changes of their type are foreseen as readily obvious to one skilled in the art.

What is claimed is:

1. A method for reconditioning and resurfacing worn bituminous concrete pavement wherein said method consists of: (a) heating and disintegrating the upper portion of said worn bituminous concrete pavement and integrating a bituminous liquid into the disintegrated bituminous concrete pavement, said heating being conducted so that said upper portion is heated to between about 180° F and about 250° F and said integration of said bituminous liquid being accomplished at least in part during the disintegration of said pavement, (b) screeding the mixture of said bituminous liquid and said disintegrated bituminous concrete pavement so as to restore the original surface grade, (c) applying onto said upper surface of said bituminous concrete pavement a quantity of non-skid, light-reflecting, multi-colored and irregularly-shaped aggregates of an inorganic vitreous pozzolanic material recovered as a residue in the high temperature burning of household waste and garbage, and (d) embedding said non-skid, light-reflecting aggregates into said upper surface of said bituminous concrete pavement so as to form a smooth surface with the aggregates fixed at the top of the pavement, said bituminous liquid being composed of at least one of the following: a combination of oils and asphalt emulsions at a temperature of between 50° F and a 150° F and a combination of oils and cut-back asphalts at a temperature of between about 100° F and 200° F, said inorganic vitreous pozzolanic material consisting of about 35 to 55% by weight of a colored, vitreous, light-reflecting substance and about 45 to 65% by weight of a pozzolanic substance, said pavement being disintegrated to a depth of between about 0.5 and about 2.5 inches and said aggregates having a maximum size of about 0.5 inch.

2. A method according to claim 1 wherein the upper portion of said worn bituminous concrete pavement is heated to a temperature of at least about 180° F and integration of the bituminous liquid is accomplished at least in part during the disintegration of the pavement.

3. A method according to claim 1 wherein between about 0.10 and about 0.60 gallons of bituminous liquid is provided for each square yard of upper surface of said pavement.

4. A method according to claim 1 wherein about 15 to about 40 pounds of said non-skid, light-reflecting aggregates are spread on each square yeard of pavement surface.

5. A method according to claim 1 wherein each of said non-skid, light-reflecting aggregates is generally about 0.12 cubic inches in volume.

6. A method according to claim 1 wherein said vitreous substance is formed, by weight, of about 26% inorganic siliceous material, about 3% alumina, about 1% soda and about 65% melted glass and about 5% other substances.

7. A method according to claim 1 wherein said pozzolanic substance is formed, by weight, of about 5% fly ash, about 3% alumina, about 87% non-vitreous siliceous material and about 5% other substances.

8. A method for reconditioning and resurfacing a worn bituminous concrete pavement so as to form a non-skid, light-reflecting pavement surface, said method consisting of:

(a) coating the upper portion of said worn bituminous concrete pavement with a bituminous liquid in an amount equal to between about 0.10 and 0.60 gallons of liquid for each square yard of pavement, (b) softening said upper portion of said worn bituminous concrete pavement by heat and mechanically distintegrating said softened upper portion to a depth of between about 0.5 and about 2.5 inches, (c) integrating said bituminous liquid into the disintegrated bituminous concrete pavement, (d) screeding the mixture of said bituminous liquid and said disintegrated bituminous concrete pavement so as to restore the original surface grade and form a new top surface, (e) applying onto said new top surface, light-reflecting colored aggregates of an inorganic vitreous pozzolanic material formed as a residue in the high temperature burning of household waste and garbage, said aggregates consisting of about 35 to 55% by weight of a colored, vitreous, light-reflecting substance and about 45 to 65% by weight of a pozzolanic substance, and (f) embedding said light-reflecting aggregates into said new top surface so as to form a smooth, non-skid, light-reflecting pavement surface.

9. A method according to claim 8 wherein between about 15 to 40 pounds of aggregate are applied for each square yard of pavement surface.

* * * * *